US005803780A

United States Patent [19]

Gutierrez, Jr.

[11] Patent Number: 5,803,780

[45] Date of Patent: Sep. 8, 1998

[54] MARKER BUOY WITH SELF-ADJUSTING INTEGRAL REEL

[76] Inventor: Salvadore Gutierrez, Jr., P.O Box 987, Mango, Fla. 33550

[21] Appl. No.: 866,595

[22] Filed: May 30, 1997

Related U.S. Application Data

[63] Continuation-in-part of Ser. No. 619,834, Mar. 19, 1996, abandoned.

[51] Int. Cl.[6] ..... B63H 22/18

[52] U.S. Cl. ..... 441/25; 43/43.1

[58] Field of Search ..... 441/1, 6, 21, 23, 441/24, 25, 26; 43/43.1, 43.11, 44.87, 44.13, 102–104

[56] References Cited

U.S. PATENT DOCUMENTS

| | | | |
|---|---|---|---|
| 3,196,469 | 7/1965 | Anthony | 441/26 |
| 4,778,422 | 10/1988 | Saulnier et al. | 441/26 |
| 4,781,636 | 11/1988 | Schurr | 441/26 |
| 5,087,216 | 2/1992 | Noggle | 441/26 |
| 5,234,365 | 8/1993 | Cooper El | 441/26 |
| 5,256,093 | 10/1993 | Balstad | 441/25 |

*Primary Examiner*—Jesus D. Sotelo
*Attorney, Agent, or Firm*—Pendorf & Cutliff

[57] ABSTRACT

A compact integrated marking buoy device which enables a person to easily mark a location on the seabed with a floating buoy. The buoy device includes a line control mechanism which enables the device, once placed in the water, to release the weight, to automatically pay out only sufficient line to connect the buoy at the surface to the weight at the seabed, and to prevent release of any excess line once the weight has reached the seabed. The device permits playing out of additional line once the level of tension on the line again exceeds the threshold. The device further allows for easy retrieval of the weight and line through means internal to the marking buoy.

19 Claims, 7 Drawing Sheets

MARKER BUOY WITH SELF-ADJUSTING INTEGRAL REEL

REFERENCE TO RELATED APPLICATIONS

This is a continuation-in-part of application Ser. No. 08/619,834 filed Mar. 19, 1996, entitled "MARKER BUOY WITH SELF-ADJUSTING INTEGRAL REEL", now abandoned.

BACKGROUND OF THE INVENTION

1. Field of the Invention

The present invention relates to a compact integrated marking buoy device which enables a person to easily mark a location on the seabed with a floating buoy. The buoy device includes a line control mechanism which enables the device, once placed in the water, to release the weight, to automatically pay out only sufficient line to connect the buoy at the surface to the weight at the seabed, and to prevent release of any excess line once the weight has reached the seabed. The device further allows for easy retrieval of the weight and line through means internal to the marking buoy.

2. Description of the Related Art

In the field of scuba diving, it is frequently not possible to determine the precise location of a dive site by visual observation from the surface alone. Rather, locating a dive site frequently involves cruising over the area of a site while watching a fathometer, and attempting to drop an anchor as soon as the fathometer indicates a change in depth corresponding to a reef, wreck, or ledge. This method is imprecise due to drifting of the boat between detection of the change in relief and dropping and playing out the anchor. An improvement over the anchoring technique is marking the dive site with a marker buoy, which typically comprises a line tied at one end to a weight and at another end to a marking buoy. Traditionally, the depth of the location to be marked is estimated, sufficient line is measured, a buoy is tied to one end of the line, and a weight is tied to the other end of the line. The weight must be heavy enough to prevent waves and current from the flow of tides the marking buoy from moving the weight along the seabed. The line must also be long enough to connect the buoy to the location to be marked at high tide as well as at low tide.

Occasionally, the line itself is marked with high visibility ribbon other visual ornaments for easy location by the divers underwater. Such marking allows the divers to descend alongside the line to insure that they reach the intended dive site.

There are several problems associated with the use of a simple line and a marking buoy. One is that the once the buoy is retrieved, the line and weight remain to be independently retrieved. Generally, such retrieval must be done by a person aboard a boat as it is difficult for a swimmer or diver to pull up the weight given the limited buoyancy of a swimmer and the ease with which a long line can become tangled with a diver's gear. Further, in order to ensure that the buoy does not lift the line and weight off the floor of the seabed during high tide, the amount of line provided is typically in excess of the depth of the seabed by a factor of about 50%.

Another significant problem with a conventional marker buoy arrangement is that the weight is often manually thrown first, with the line trailing behind, and thereafter the buoy is thrown. This is an inexact and potentially hazardous process, since the line can easily be entangled upon a person or an object on the boat, and the weight and line poses a risk to any swimmer or diver which may be nearby the intended marking location.

Given the above problems, several devices have been developed to make marking of a dive or fishing site more convenient. These devices generally have a line release and retrieval means, such as a reel, integrated into the marking buoy. See, for example, U.S. Pat. No. 5,087,216 to Noggle which teaches a marker buoy with an integrated reel.

An improvement which includes a means to prevent payout of excess line between the weight and buoy is disclosed in U.S. Pat. No. 5,256,093 to Balstad. Balstad teaches a marking buoy comprising a cylinder, a spool with a crank shaft housed in the cylinder, a float at one end of the cylinder, a lead weight at the other end of the cylinder, with the lead weight attached to the spool via a line. When tossed in the water, two things happen. First, the lead weight sinks, unwinding the line from the spool. Second, the cylinder, which initially floats sideways in an orientation which permits unwinding of line from the spool, gradually fills up with water such that the buoy gradually becomes upright. As the buoy rights itself, a smaller float in the cylinder under the spool is pushed upwards by the water, this smaller float in turn pushing a cam, the cam preventing further unwinding of the spool.

Once the buoy of Balstad has righted itself, no further paying out of line is possible. In order to prevent the weight from being lifted and moved or to prevent the buoy from submerging as the distance between the weight on the seabed and the buoy increases for tides, waves or swells, Balstad provides a segment of shock cord in the line. The shock cord is intended to provide for some elastic adjustment in line length. However, shock cord can only stretch to a certain point, beyond which either the buoy will submerge or the weight will rise.

U.S. Pat. No. 5,234,365 to Cooper et al. teaches a marker buoy apparatus which is used for fishing positioning. The Cooper device is designed to mark and remain stationary over one location for purposes of fishing, and it also may contain other apparatus for fishing. The marking buoy is quite large, unwieldy and fragile, and is not designed forced to be thrown from a boat.

Accordingly, there is a need for a marker buoy which addresses the above problems and provides a compact, rugged, economical means for conveniently marking dive sites.

SUMMARY OF THE INVENTION

After extensive experimentation, the present inventor discovered that the above difficulties could be overcome by a marker buoy for marking an underwater location, which marker buoy comprises a buoyant housing, a line release control means for controlling release of the line, and a line retrieval means for retrieval of the line. The line release control means and line retrieval means each serve different functions, but may be operatively associated with and/or include common structural elements such as a hand crank which serves to permit retrieval of line upon the reel upon which the line is spooled, which hand crank may also have the line release control means incorporated therein.

The line release control means is used to control the amount of line released, and is designed to operate automatically to permit a necessary amount of line to be released or played out once the buoy is placed in the water with the lead weight released. The line control means pays out line as the lead weight descends and during descent applies a predetermined amount of tension to the line release control means. Once the lead weight hits the floor of the seabed, the amount of tension is reduced and the line release control means automatically prevents paying out of further line. Thus, only that precise amount of line needed to position the buoy over the spot on the seabed to be marked is played out.

While the buoy is marking a location, the distance between seabed and water surface may change due to tides, etc. The line release control means is designed to permit paying out of additional line in response to a signal indicating that the line length is insufficient, the signal being, e.g., line tension exceeding of a predetermined threshold of line tension. In a preferred embodiment, the line release control means is a slip clutch which permits the line reel to revolve a single rotation or revolution thereby paying out a short segment of line in response to the exceeding of a predetermined level of tension.

The line retrieval means is used to retrieve the line, and is manually operated. The line retrieval means may include a crank operatively associated with the reel for reeling in the line.

The marker buoy is designed to securely hold the buoy in place once the minimal amount of line has been played out for marking the underwater location, and yet release line only as necessary to prevent lifting of the weight from the sea bed or to prevent submersion of the buoy.

It is yet a further object of the present invention to provide a simple, durable marker buoy having the above capabilities which is capable of withstanding impact from boat hulls without harm to the internal line control means or external hardware.

It is another object of the invention to provide a marker buoy upon which a dive flag as employed by divers can be mounted.

It is another object of the present invention to provide a marking buoy with the above functions which is economic to produce.

Accordingly, the present invention concerns a marking buoy comprising:

a buoyant housing, a reel mounted rotatably within said buoyant housing, a weight, a line connected at one end to said weight and at the other end to said reel, line release control means operatively associated with said reel for automatically controlling the amount of line released, and line retrieval means operatively associated with said reel for manual retrieval of line.

The line release control means is preferably a slip clutch which locks the reel against rotation so long as the amount of tension is below a predetermined value, releases the reel for rotation so long as the tension on the line exceeds the predetermined value, and again locks the reel against rotation so long as the amount of tension remains below a predetermined value.

The marker buoy preferably includes means for facilitating manipulation of the buoy and control of the line during retrieval, such as a channel or tube which projects from the housing and serves both as a handle for holding the buoy during retrieval of the line and as a conduit through which line is fed to the reel in the interior of the buoyant housing. This tube preferably defines the bottom of the buoy, and is preferably also provided with a weight at or near the distal end thereof so that the distal end of the tube points downwardly when the tube is floating in the water. To the extent that the marker buoy is oriented with the tube facing downwardly when deployed in the water, the marker buoy may also be provided with attachment means for securing a dive flag to the top of the buoy.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other filled bread products for carrying out the same purposes of the present invention. It should also be realized by those skilled in the art that such equivalent structures do not depart from the spirit and scope of the invention as set forth in the appended claims.

DETAILED DESCRIPTION OF THE INVENTION

Figure 1:
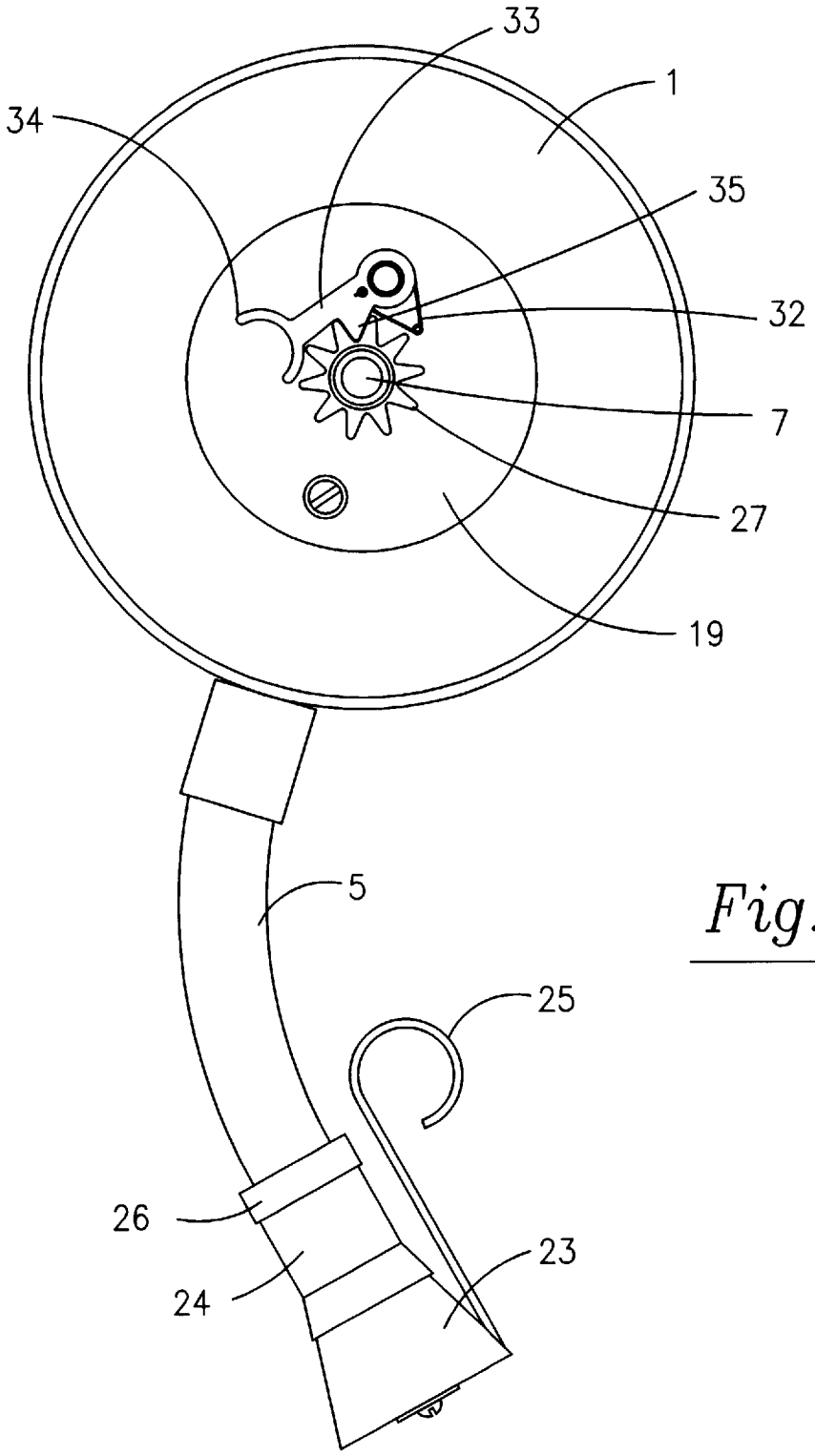
FIG. 1 is a right side perspective view of a first embodiment of a marking buoy according to the invention.
Figure 2:
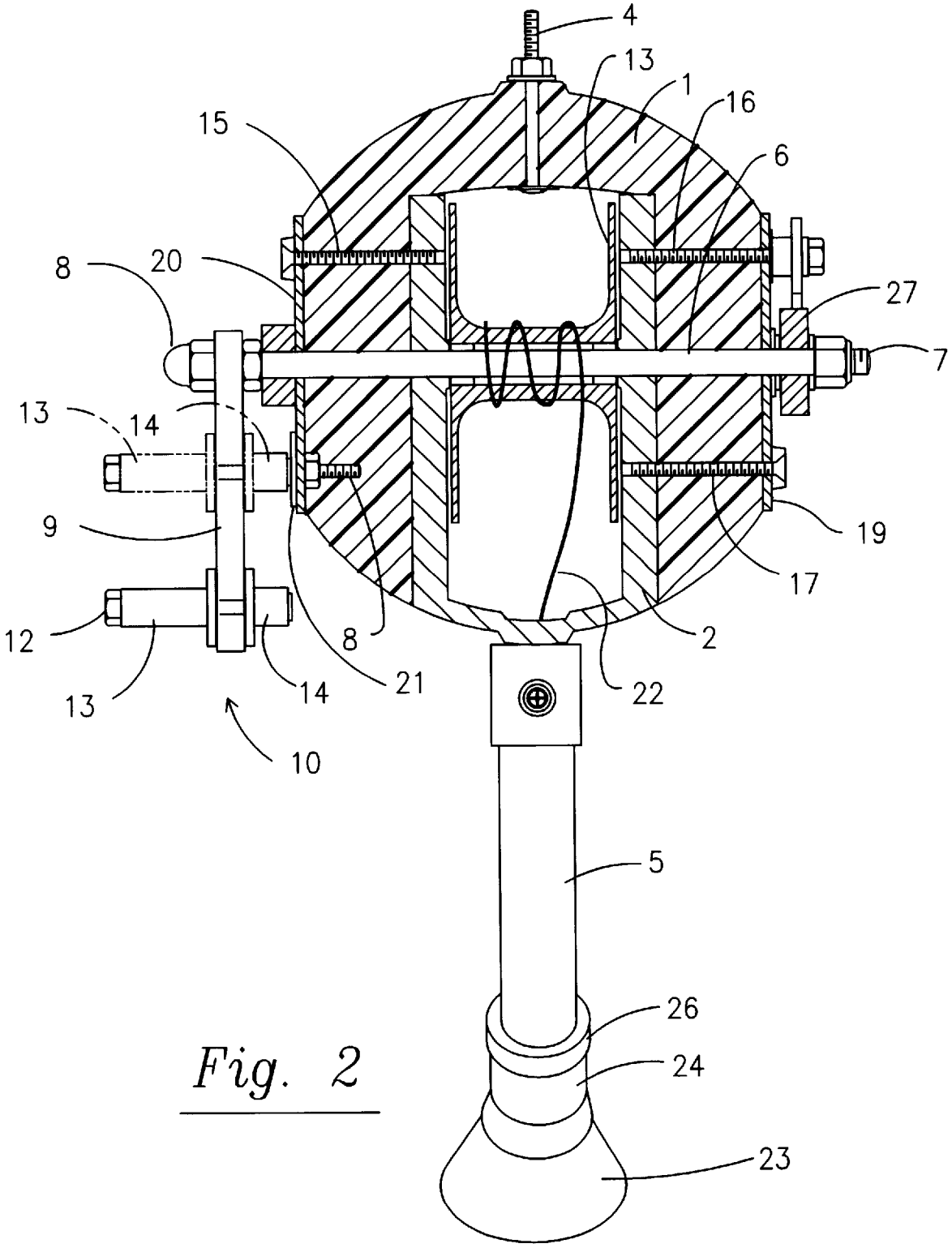
FIG. 2 is a front perspective view of the marking buoy according to FIG. 1.
Figure 3:
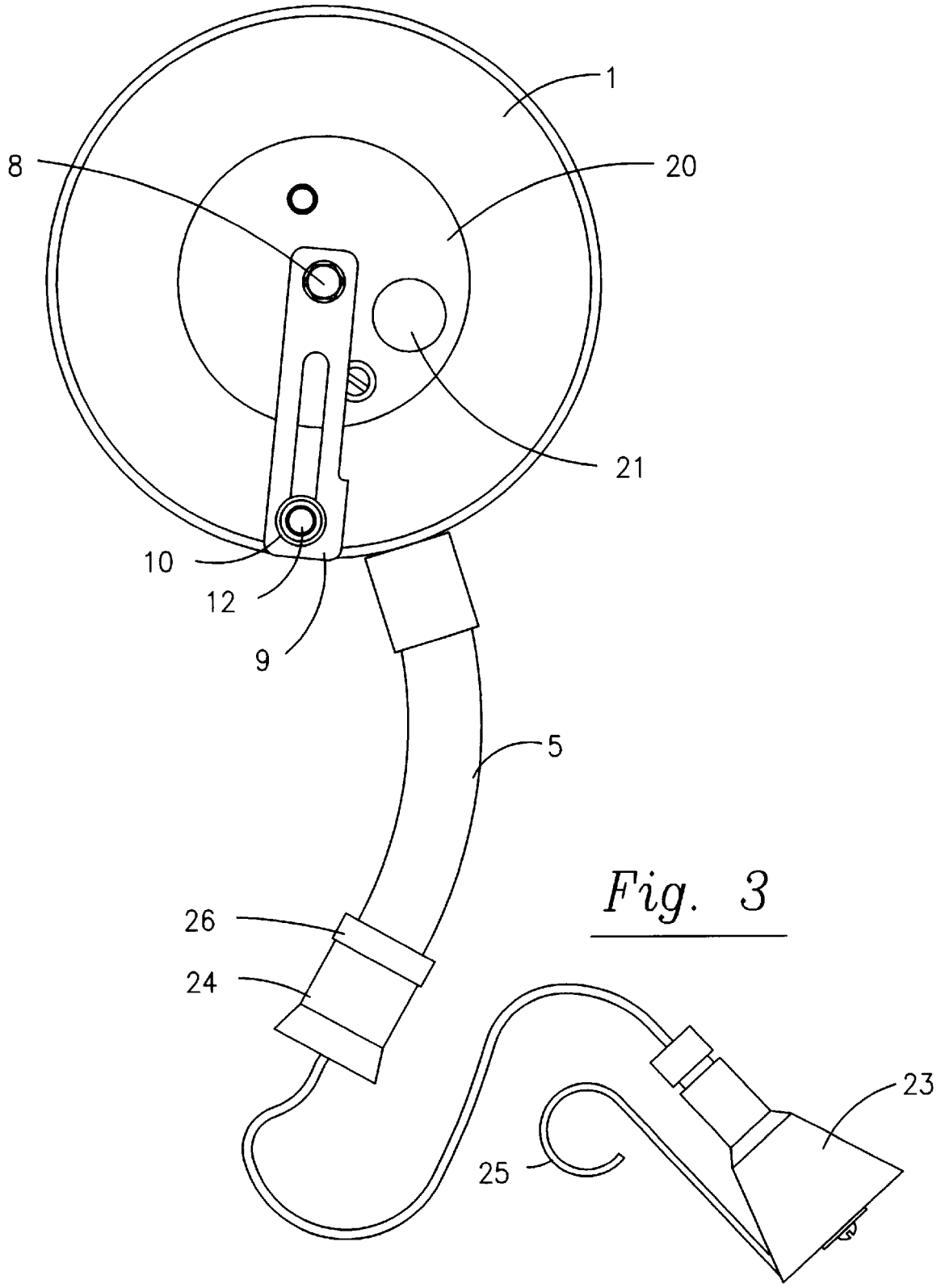
FIG. 3 is a left side perspective view of the marker buoy according to FIG. 1, with the weight and line partially released.

The marker buoy according to the present invention will now be described by reference to a preferred embodiment as illustrated in the figures. The marker buoy includes a buoyant housing which, in the preferred embodiment, is comprised of an outer buoyant housing 1 and an inner ridged frame 2. The outer buoyant housing is comprised of any water resistant buoyant material, preferably a water resistant plastic such as blown STYROFOAM or foamed acrolein nitrile-butted diene-styrene, or maybe a hollow shape formed of nylon or polypropylene or polyethylene. Frame 2 provides structures rigidity for mounting of reel 3 and for durability and longevity of the marker buoy. The frame 2 and buoyant housing 1 together have a top and a bottom. The top is preferably provided with a means for mounting a dive flag, such as a threaded projection 4. The bottom of the buoy housing includes means for attachment of a tubular projection 5. The tubular projection may be made of any material and is preferably of a sufficient diameter that it can be grasped by one hand while operating the crank during rewinding with the other hand. In the embodiment as shown in FIG. 1, the tubular projection preferably has a diameter of approximately 1 inch and a length of approximately 6–8 inches. As shown in FIGS. 1 and 3, the tubular projection is preferably marked or bent in order that the proximal end of the tubular projection can be held horizontally while the distal end of the tubular projection is directed towards the water from which the line and anchor weight are being retrieved.

Extending transversely through the buoyant housing 1 and frame 2 is a shaft 6, preferably made of stainless steel, KEVLAR, polycarbonate, or fiberglass. Attached centrally to the shaft is reel 3. Shaft 6 has a left end 7 and a right end 8. Attached to the right end 8 is a crank arm 9 and crank handle 10. Rotation of crank arm 9 causes rotation of shaft 6 and thus rotation of reel 3.

As seen from FIG. 1, the left end 7 of shaft 6 is provided with a ratchet wheel having a tooth profile 27. Locking lever 33 is provided with a locking tapper 35 which enters into the tooth profile of ratchet wheel 27 to prevent rotation in one direction. Spring 32 operates to urge locking tapper 35 into the tooth profile. Spring 32 is designed such that when locking lever 33 disengaged from ratchet wheel 27 by pivoting free end 34 of locking lever 33 away from ratchet wheel 27, spring 32 keeps locking lever 33 and locking tapper 35 in a disengaged position out of engagement with ratchet wheel 27 such that shaft 6, and thus reel 3 are free to rotate.

Onto the right end 8 of shaft 6 is provided crank arm 9. Slot 11 is formed in crank arm 9. Crank handle 10 is comprised of a screw shift 12 which extends through said slot 11. Onto the end of screw 12 which extends perpendicularly to said crank arm 9 and away from the buoyant housing is a crank handle 13 which serves also as a counter-weight to magnet 14. Onto the other end of screw 12 is provided a magnet 14. Between the counter-weight 13 and crank arm 9 and between magnet 14 and crank arm 9 are flanges, preferably stainless steel washers, which facilitate the ability of the crank handle assembly 10 to slide within said slot 11. Crank handle 10 is heavy and its position in crank arm 9 is dictated by gravity and by centrifugal forces.

In order to improve wear resistance, anti-wear plates 19, 20 are bolted onto the left and right sides of the buoyant housing by means of screws 15, 16, 17, 18. Screw 16 also serves to mount locking lever 33 and defines the pivot axis of the locking lever 33.

Screw 18 serves to secure metal disk 21 onto wear resistant plate 20 and a position underlying the proximal end of slot 11.

Line 22 is wound about reel 3 and extends through tubular projection 5 to anchor weight 23. The distal end of tubular projection 5 is preferably also provided with a weight 26 which serves to orient tubular projection 5 downwards during deployment of line 22. If buoyant housing 1 is provided with means 4 for mounting a small mast and dive flag, weight 26 should be heavy enough to keep the dive flag up in the air and out of the water. The lower end 24 of projection is preferably flared out, giving the shape of a hollow cone. This lower end may be made of a durable plastic, or may be a salt water resistant metal such as lead. Anchor weight 23 is preferably in the shape of a cone for ease of insertion into the opening of lower end 24 of projection 5. Anchor weight 23 may be widely selected, any where from 1 to 6 ounces, depending upon the anticipated sea state, the size of buoyant housing 1, and whether or not a dive flag is to be used. Line 22 may be any where from 20 to 150 feet, depending upon intended use.

Anchor weight 23 is preferably with finger hold 25 including a first end attached to the anchor weight and a second end through which a finger can be inserted.

While a magnetic clutch as discussed above may have certain advantages such as ease of maintenance, it is difficult to adjust the release setting on a magnetic clutch. Accordingly, the present invention contemplates alternative engagement means which are also exposed and easy to clean and repair, and further are easy to adjust (depending upon, e.g., sea state, wind, etc.). The alternative engagement means are preferably provided on the housing and are so positioned as to releasably engage a part of the crank handle as the crank handle, while in the radially inward position, passes by the engagement means.

Figure 4:
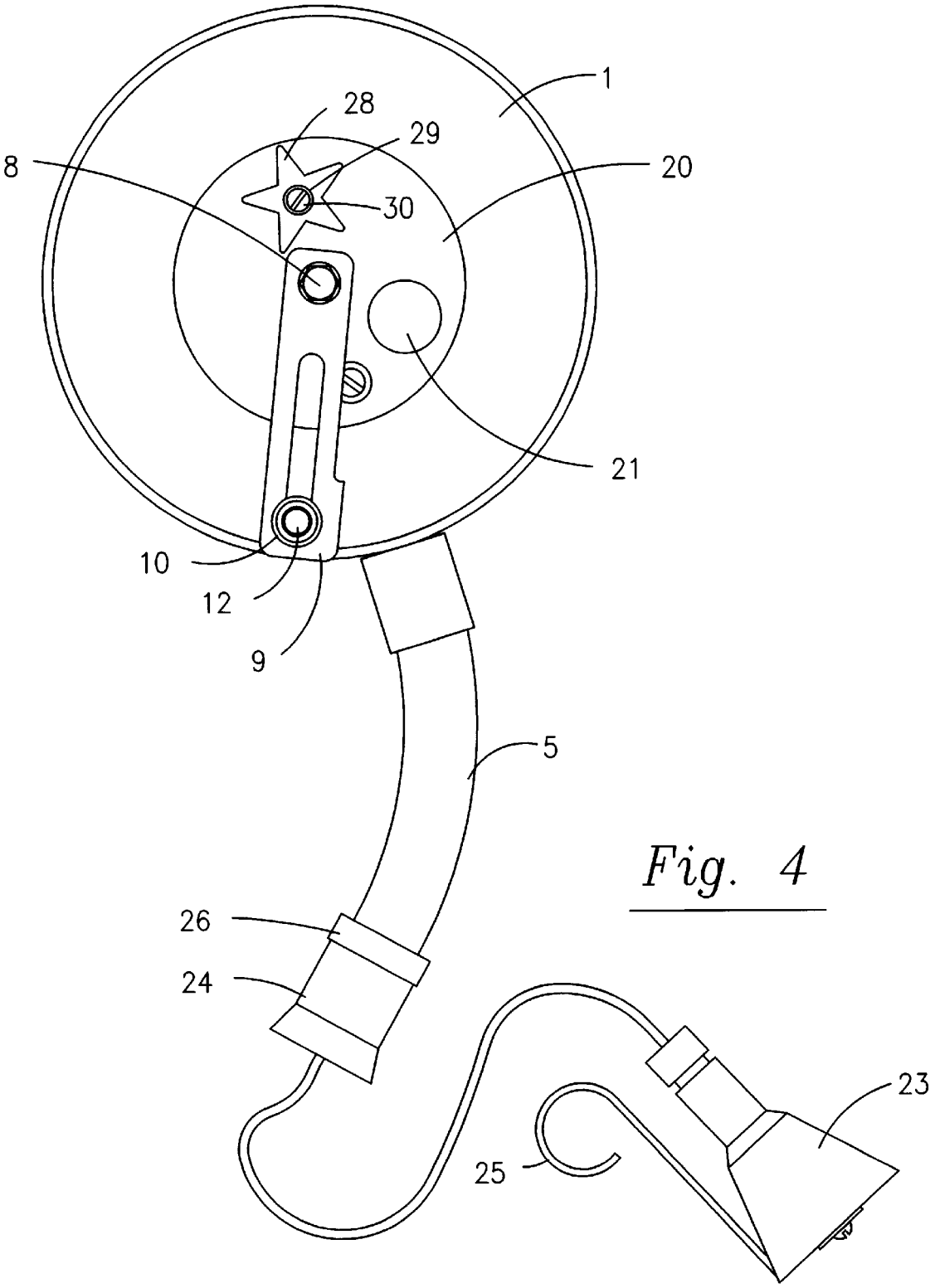
FIG. 4 is a left side perspective view of a second embodiment of a marking buoy according to the invention, with the weight and line partially released.
Figure 5:
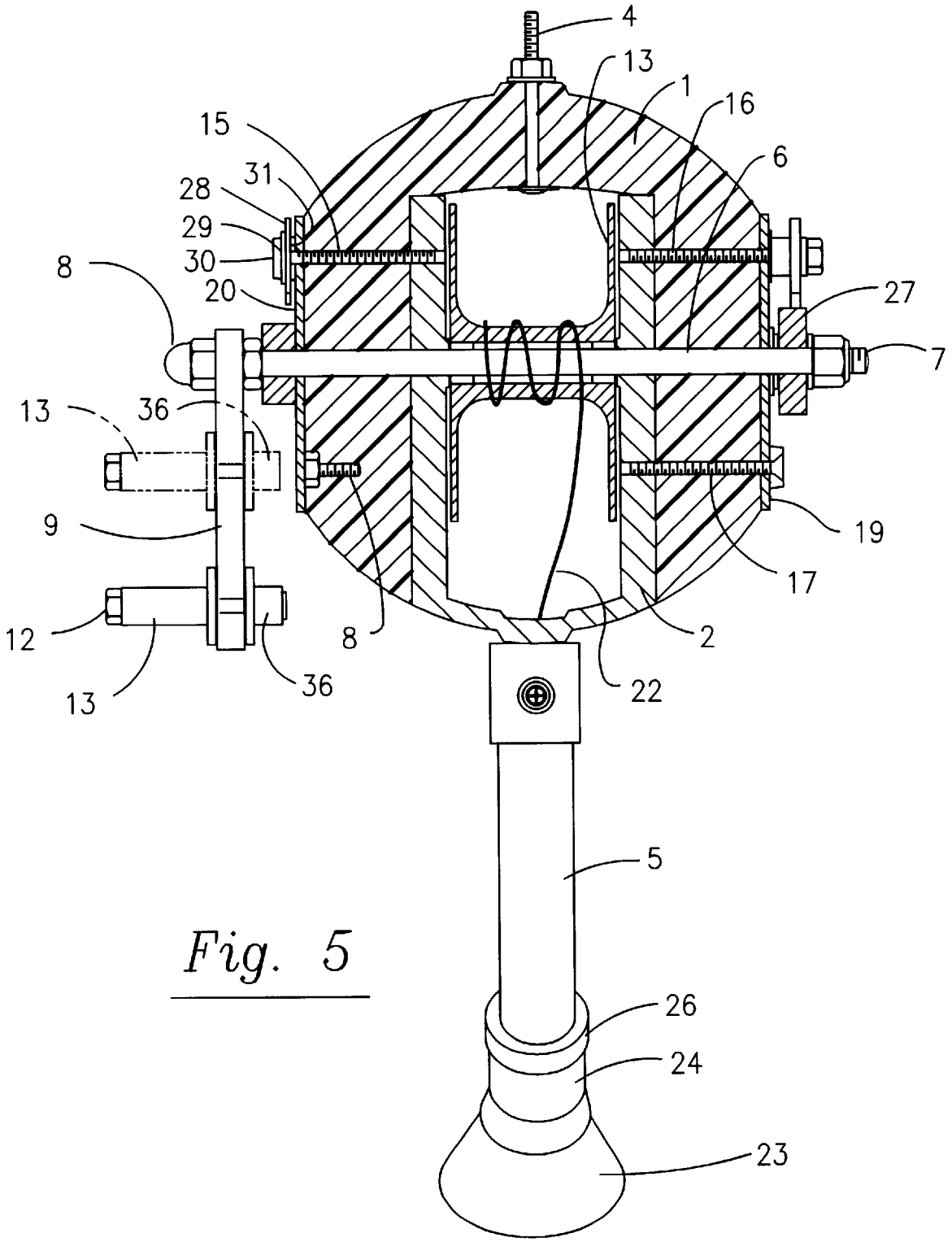
FIG. 5 is a front perspective view of the marking buoy according to FIG. 4.

Such an engagement means may be, for example, a tooth gear 28 frictionally held between washers 29, 31 by screw 15 as shown in FIGS. 4 and 5. In this case, as a projecting part 36 of crank handle 13 facing and projecting towards the buoy housing is in the radially outward position (the radially outward position being shown in solid lines in FIG. 7), when the projecting part 36 passes by tooth gear 28, it will engage with the teeth of the gear 28. If the crank handle is being pulled with sufficient tension by line 22, for example, while lead weight 23 is being deployed or a wave lifts the marker buoy, the crank handle 10 will overcome the frictional resistance of the tooth gear and cause the tooth gear to rotate, permitting crank handle to pass and attempt a further revolution. In the case that the line 22 does not draw from reel with much force (indicating, e.g., that the lead weight has hit the bottom of the ocean) the crank handle will not be able to overcome the friction of the tooth gear and will not complete a further rotation.

Figure 6:
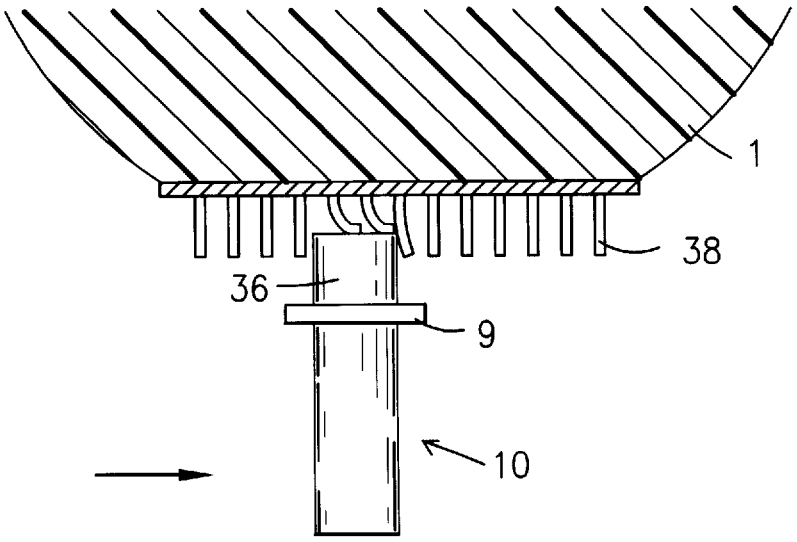
FIG. 6 is a top view of a third embodiment of the marking buoy according to the invention.

Yet a further alternative embodiment is illustrated in FIG. 6, wherein the projecting part 36 of crank handle 10 passes through elastic bristles or fingers 38 which serve to retard but not completely block the passage of part 36. It is readily obvious that these elastic bristles will work in the same manner as a magnet or friction tooth gear, and merely represents an alternative means for accomplishing the same result. While it is preferable to make the fingers 38 of a material which will withstand salt water and intense sunlight, this is not an absolute requirement since replacement of this element is easy.

Figure 7:
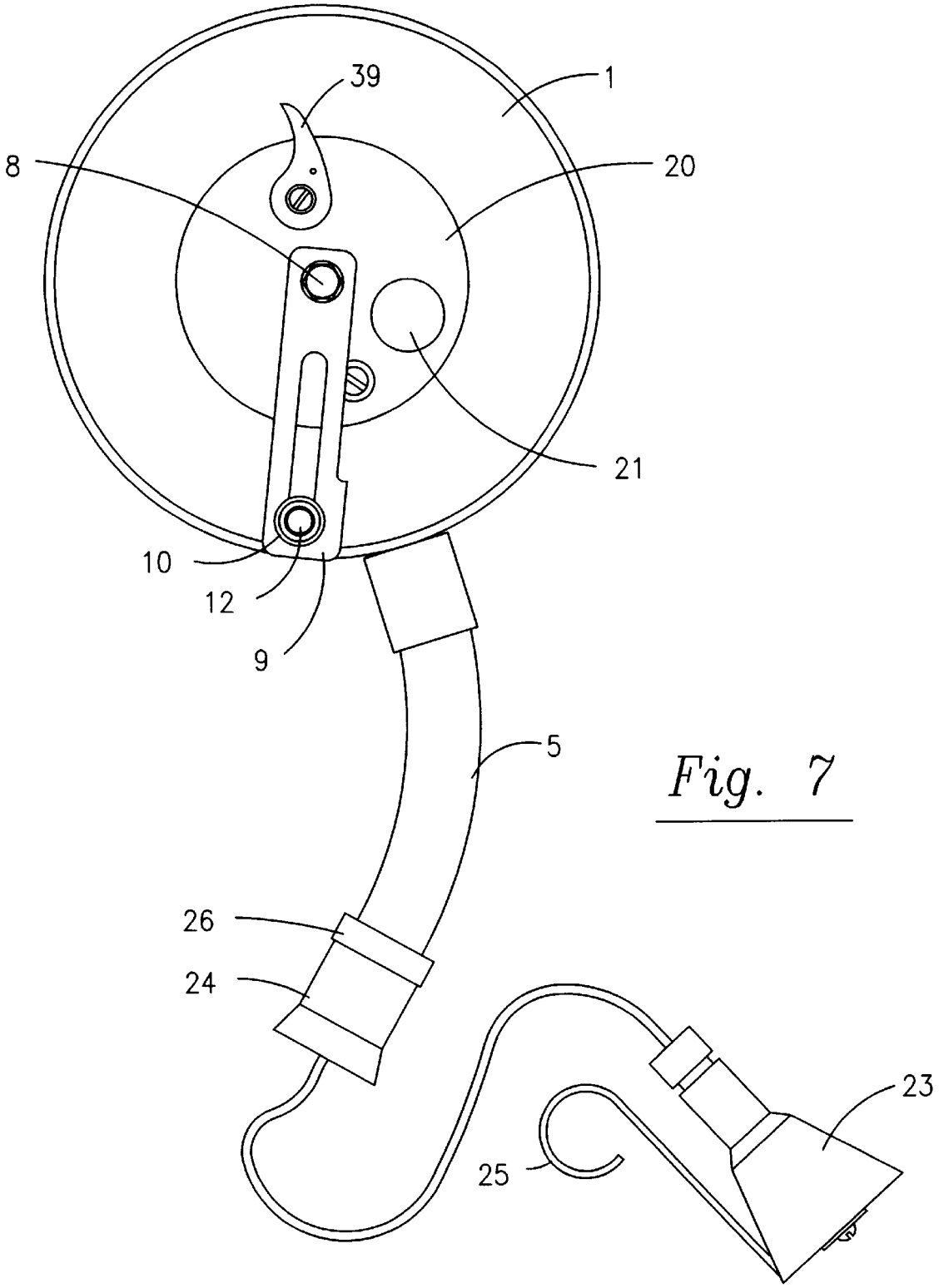
FIG. 7 is a left side perspective view of a fourth embodiment of the marking buoy according to the invention.

A fourth alternative embodiment is shown in FIG. 7. A trigger 30 is mounted on the housing and is spring-biased to be in the path of the handle 10 when the handle is in the radially inward position. The handle 10, when in the radially outward position as during playing out or reeling in of line, will not make contact with the trigger, and is free to revolve with the crank. When, during playing out, the tension in the line drops below the tension needed to maintain handle 10 in the radially outward position, handle 10 will contact the trigger as it passes by the trigger. When the tension drops below the tension needed to urge handle 10 past trigger 30, the trigger will catch the handle and prevent further rotation until such time as the tension on the line again increases, as during an incoming tide or wave action. When the tension increases beyond the threshold, handle 10 will urge past trigger 30 and will revolve until the tension is again below the threshold needed to pass the trigger. It will be readily apparent that the spring biasing the trigger will work in two directions (clockwise and counterclockwise), and that the device is thus capable of being used by either right handed people or left handed people with no, or minor, modifications.

The operation of the preferred device according to the present invention will now be described.

FIG. 1 shows the marker buoy according to the invention in the stored position with locking lever 33 engaged with ratchet wheel 27. Prior to the employment a finger is inserted through finger hold 25 in order to prevent premature release and playing out of anchor weight 23 and line 22. Preferably, one hand grasps tubular projection 5 and a finger of that hand is inserted through finger hold 25. The other hand can now rotate the free end 34 of locking level 33 into the disengaged position whereupon ratchet wheel 27 is free to rotate. Once ratchet wheel 27 is free to rotate, shaft 6 and crank arm 9, as well as reel 3 may also rotate. The entire device is thrown overboard and anchor weight 23 begins to descend by gravity, pulling line 22 along with it and causing reel 3 to rotate rapidly. As reel 3 is rapidly rotating, crank arm 9 is also rotating. As crank arm 9 rotates, crank handle 10 is thrown outwards to the distal end of crank arm 9 by centrifugal force. So long as reel 3 is rotating rapidly, crank handle 12 is at the outer or distal end of crank arm 9 and magnet 14 is kept away from metal disk 21.

When anchor weight 23 reaches the seabed, tension is immediately taken off line 22 and reel 3 slows down and stops rotating. As the rotational speed of reel 3, shaft 6 and crank arm 9 slow down, the centrifugal force which keeps crank handle 10 thrown out distally is reduced, and during the time that crank arm 9 is directed upwardly gravitational forces may pull crank handle 10 downwards or proximally. As crank handle 10 drops in slot 11 and is at the proximal end of slot 11, crank arm 9 continues to rotate further until crank arm 9 passes over metal disk 21. Crank handle 10 including magnet 14, are at this time directly over metal disk 21, and magnet 14 becomes firmly attached to metal disk 21, thereby arresting crank arm 9, shaft 6 and reel 3 against further rotation.

With magnet 14 attached to metal disk 21, the marker buoy is automatically positioned over the site to be marked with the amount of line 22 automatically adjusted to the minimal amount necessary to position the buoyant housing 1 over the site to be marked. Magnet 14 is held on metal disk 21 by a predetermined amount of magnetic force. The magnetic force does not exceed the amount of force needed to either lift the anchor weight from the floor of the seabed or to pull buoyant housing 1 under the surface of the water. That is, in the case that either anchor weight 23 is lifted off of the floor of the seabed, or buoyant housing 1 is submerged under the surface of the water, the tension on line 22 between the gravitational pull of anchor weight 23 and the flotation effect of buoyant housing 1 is sufficient to urge crank arm 9 to pull magnet 14 off of metal disk 21 and to permit crank arm 9 to commence about one full rotation, thereby playing out a small amount of line. In the case that this played out amount of line is insufficient to release the tension on line 22, crank arm 9 is again urged to disengage magnet 14 from metal disk 21 and to permit reel 5 to commence a further rotation. This continues so long as necessary to reduce the tension on line 22 below a predetermined threshold value. For example, in the case that the marker buoy is thrown into a bay at low tide, anchor weight 23 will rapidly drop and draw line 22 off of reel 3 until anchor weight 23 reaches the floor and at that time crank arm 9 will cease rotation and magnet 14 will drop in raised arm 9 and attach to metal disk 21. As the tide rises in the bay and the distance between the floor of the bay and the surface of the water increases, tension in line 22 will increase. As the tension increases, crank arm 9 is caused to rotate and disengage magnet 14 from metal disk 21. Crank arm 9 rotates only so long as tension in line 22 is sufficient to disengage magnet 14 from metal disk 21. Once sufficient line has played out to decrease the tension in line 22 below the amount of tension necessary to disengage magnet 14 from metal disk 21, magnet 14 locks onto metal disk 21 in order to prevent any further rotation of reel 3.

As apparent from the above, the advantage of the present invention is that the magnet 14 and metal disk 21, or the alternate engagement means described above, operate in a manner of a slip clutch of which the operation is assured over a wide variety of conditions. The ability of magnet 14 to connect with metal disk 21 is not effected by wear, temperature, salinity, lubrication, etc. This slip clutch arrangement has advantages over an arrangement implying, for example, a locking ratchet which may be subjected to wear, a device which attempts to apply a frictional cam against line 22 which is likely to wear, etc.

A further advantage of the marker buoy according to the preferred embodiment is in the ability of the outer surface to be provided with a highly visible coating such as a dayglow color or international orange. It is further possible to provide a mounting means at the upper end of the buoyant housing and a weight 23 at the distal end of tubular projection 5 and diametrically opposed to mount 4 such that a light weight pole with a dive flag attached to the top may be attached to mount 4. This further increases the visibility of the marking site and indicates the presence of divers to other boats in the area.

Retrieval of the marker buoy according to the invention will now be explained.

In order to retrieve the marker buoy, the boat is brought to the side of the marker buoy and the pull or mast on which the dive flag is attached may be grasped and the marker buoy pulled up to the operator. Tubular projection 5 is grasped by one hand, for example, the left and crank handle 10 is grasped by, for example, the right hand. Movement of crank handle away from metal disk 21 to the distal end of slot 11 from its easy rotation and thus cranking of crank arm 9. As crank arm 9 is cranked, locking lever 12 may be left in the disengaged positioned or locking lever 12 may be pivoted to the engaged position as shown in FIG. 1. Crank handle 10 is operated to wind line 22 about reel 3 until anchor weight 23 is brought all the way snugly into the conical opening weight 24. At this time finger hold 25 can be grasped by a finger of the left hand and locking lever 12 can be pivoted into the engaged positioned using the right hand. The marker buoy is now in the storage condition ready for storage.

Although the marker buoy was described herein with great detail with respect to a marker buoy for marking a dive location, it will be readily apparent that the device capable of use in a number of other applications. Although this invention has been described in its preferred form with a certain degree of particularity with respect to a marker buoy for marking a dive site, it is understood that the present disclosure of the preferred form has been made only by way of example and that numerous changes in the details of structures and the composition of the combination may be resorted to without departing from the spirit and scope of the invention.

Now that the invention has been described,

I claim:

1. A marker buoy, comprising:

a buoyant housing having a top and a bottom, a reel mounted rotatably within said buoyant housing, a weight, a line connected at one end to said weight and at the other end to said reel, line retrieval means operatively associated with said reel for manual retrieval of line, said line retrieval means including a crank operatively associated with the reel for reeling in said line, said crank comprising a crank shaft connected to said reel, a crank arm having a slot defined therein and connected to said crank shaft, and a crank handle slidingly situated in said slot of said crank handle for sliding between a radially outward and a radially inward position, engagement means provided on said housing for releasably engaging said crank arm when said crank arm is in the radially inward position, wherein said engagement means engages said crank handle to lock said reel against rotation so long as the tension on said line is below a predetermined threshold value, releases said crank handle to release said reel for rotation so long as the tension on said line exceeds said threshold value, and again engages said crank handle to locks said reel against rotation so long as the amount of tension again drops below said threshold value, such that during deployment of said line and rotation of said crank shaft and crank arm said crank handle is maintained in said radially outward position by centrifugal force and said crank shaft is free to rotate, and wherein after deployment of said line said crank handle is not maintained in said radially outward position by centrifugal force and is thus permitted to drop to said radially inward position for engagement with said engagement means.

2. A marker buoy as in claim 1, wherein said engagement means is a magnetic engagement means forming a magnetic slip clutch.

3. A marker buoy as in claim 1, wherein said engagement means is a tooth gear having multiple teeth, wherein the teeth of said tooth gear are designed to engage said crank handle only when said crank handle is in the radially inward position, and wherein said tooth gear is frictionally restrained against rotation so as to rotate only upon exceeding a predetermined threshold force.

4. A marker buoy as in claim 1, wherein said engagement means includes a flexible or pivotable contact member designed to yieldingly contact said crank handle only when said crank handle is in the radially inward position, and wherein said flexible or pivotable contact member releases said crank handle upon exceeding a predetermined threshold force.

5. A marker buoy as in claim 1, further including a spring biased locking system for locking said reel against rotation in one direction.

6. A marker buoy as in claim 1, further including a tubular projection which projects from the housing and serves both as a handle for holding the buoy during retrieval of the line and as a conduit through which line is fed to the reel in the interior of the buoyant housing.

7. A marker buoy as in claim 6, wherein said tubular projection projects from the bottom of the buoy, and is provided with said weight at or near the distal end thereof.

8. A marker buoy as in claim 1, wherein said housing is provided with attachment means for securing a flag mast to the top of the buoy.

9. A marker buoy as in claim 1, further including a pole extending from the top of said buoy, and a dive flag attached to said pole.

10. A marker buoy, comprising:

a buoyant housing having a top and a bottom, a reel mounted rotatably within said buoyant housing, a weight, a line connected at one end to said weight and at the other end to said reel, magnetic slip clutch line release control means operatively associated with said reel for automatically releasing line in response to tension placed upon said line when said tension exceeds a predetermined threshold and for preventing release of said line when tension does not exceed said threshold, and line retrieval means operatively associated with said reel for manual retrieval of line, wherein said line release control means is a magnetic slip clutch which locks the reel against rotation so long as the amount of tension is below a predetermined threshold value, releases the reel for rotation so long as the tension on the line exceeds the predetermined value, and again locks the reel against rotation so long as the amount of tension remains below said predetermined value, wherein said line retrieval means includes a crank operatively associated with the reel for reeling in the line.

11. A marker buoy, comprising:

a buoyant housing having a top and a bottom and including a first magnetic coupling element, a reel mounted rotatably within said buoyant housing, a weight, a line connected at one end to said weight and at the other end to said reel, line retrieval means comprising a crank shaft connected to said reel, a crank arm having a slot defined therein and connected to said crank shaft, and a crank handle slidingly situated in said slot of said crank handle for sliding between a radially outward and a radially inward position, said crank handle including a second magnetic coupling means capable of magnetic coupling with said first magnetic coupling means when said crank handle is in said radially inward position, wherein during deployment of said line and rotation of said crank shaft and crank arm said crank handle is maintained in said radially outward position by centrifugal force and said crank shaft is free to rotate, and wherein after deployment of said line said crank handle is not maintained in said radially outward position by centrifugal force and is thus permitted to drop to said radially inward position whereupon said first and second magnetic coupling elements couple to form a magnetic slip clutch for preventing release of said line when tension does not exceed a predetermined threshold and automatically releasing line in response to tension placed upon said line exceeding said predetermined threshold.

12. A marker buoy as in claim 11, wherein said marker buoy further includes a tubular projection which projects from the housing and serves both as a handle for holding the buoy during retrieval of the line and as a conduit through which line is fed to the reel in the interior of the buoyant housing, said tubular projection projecting from the bottom of said marker buoy housing and provided with a weight at or near the distal end thereof.

13. A marker buoy as in claim 11, wherein said first magnetic coupling means is a magnet.

14. A marker buoy as in claim 11, wherein said second magnetic coupling means is a magnet.

15. A marker buoy as in claim 11, further including a spring biased locking system for locking said reel against rotation in one direction.

16. A marker buoy as in claim 11, further including a tubular projection which projects from the housing and serves both as a handle for holding the buoy during retrieval of the line and as a conduit through which line is fed to the reel in the interior of the buoyant housing.

17. A marker buoy as in claim 16, wherein said tubular projection projects from the bottom of the buoy, and is provided with said weight at or near the distal end thereof.

18. A marker buoy as in claim 11, wherein said housing is provided with attachment means for securing a flag mast to the top of the buoy.

19. A marker buoy as in claim 11, further including a pole extending from the top of said buoy, and a dive flag attached to said pole.

* * * * *